US005931552A

United States Patent [19]

Perrier

[11] Patent Number: 5,931,552

[45] Date of Patent: Aug. 3, 1999

[54] STORAGE FURNITURE

[75] Inventor: Guy Perrier, Larrivoire, France

[73] Assignee: Grosfillex S.A.R.L., Oyonnax, France

[21] Appl. No.: 08/744,778

[22] Filed: Nov. 6, 1996

[30] Foreign Application Priority Data

Nov. 8, 1995 [FR] France ..... 95 13229

[51] Int. Cl.[6] ..... A47B 47/00

[52] U.S. Cl. ..... 312/263; 312/257.1; 403/407.1

[58] Field of Search ..... 312/257.1, 263, 312/258, 264, 265, 265.5, 111, 140; 403/406.1, 407.1

[56] References Cited

U.S. PATENT DOCUMENTS

| | | | |
|---|---|---|---|
| 3,493,281 | 2/1970 | Kile | 312/257.1 |
| 3,779,623 | 12/1973 | Motohashi | 312/257.1 |
| 3,841,727 | 10/1974 | Peng | 312/257.1 X |
| 4,130,971 | 12/1978 | Herrig | 312/263 X |
| 5,048,902 | 9/1991 | Daly | 312/257.1 X |
| 5,221,131 | 6/1993 | Lesperance et al. | 312/263 |
| 5,240,317 | 8/1993 | Presnick | 312/263 |
| 5,642,923 | 7/1997 | Meacham et al. | 312/258 |

FOREIGN PATENT DOCUMENTS

| | | | |
|---|---|---|---|
| 1122957 | 9/1956 | France | 312/257.1 |
| 1 357 057 | 7/1964 | France . | |
| 2334324 | 7/1977 | France | 312/263 |
| 2422363 | 11/1979 | France . | |
| 26 20 402 | 11/1977 | Germany . | |
| 414480 | 6/1947 | Italy | 312/257.1 |
| 637814 | 4/1962 | Italy | 312/257.1 |
| 495729 | 9/1970 | Switzerland . | |
| 1489875 | 1/1974 | United Kingdom . | |

*Primary Examiner*—Peter M. Cuomo
*Assistant Examiner*—James O. Hansen
*Attorney, Agent, or Firm*—Wolf, Greenfield & Sacks, P.C.

[57] ABSTRACT

The present invention relates to a piece of storage furniture including two substantially rectangular shelves, respectively a top shelf and a bottom shelf. The shelves are supported by combination parts which comprise a support that is integral with a flank. The furniture also includes a front face, a back face and two side faces. The faces can be open or closed where the flank can serve as a wall that closes a face. The invention allows the furniture to be assembled or disassembled in a facile manner and when disassembled, the furniture is provided as a compact package.

20 Claims, 3 Drawing Sheets

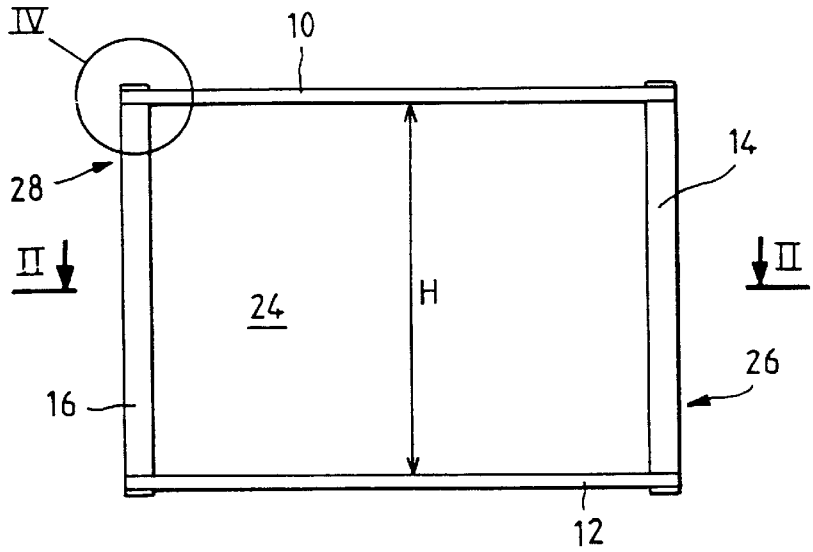
FIG.1
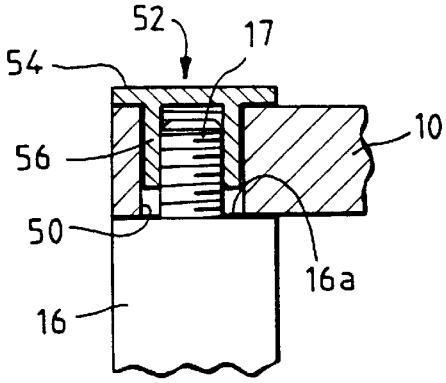
FIG.4
FIG.2
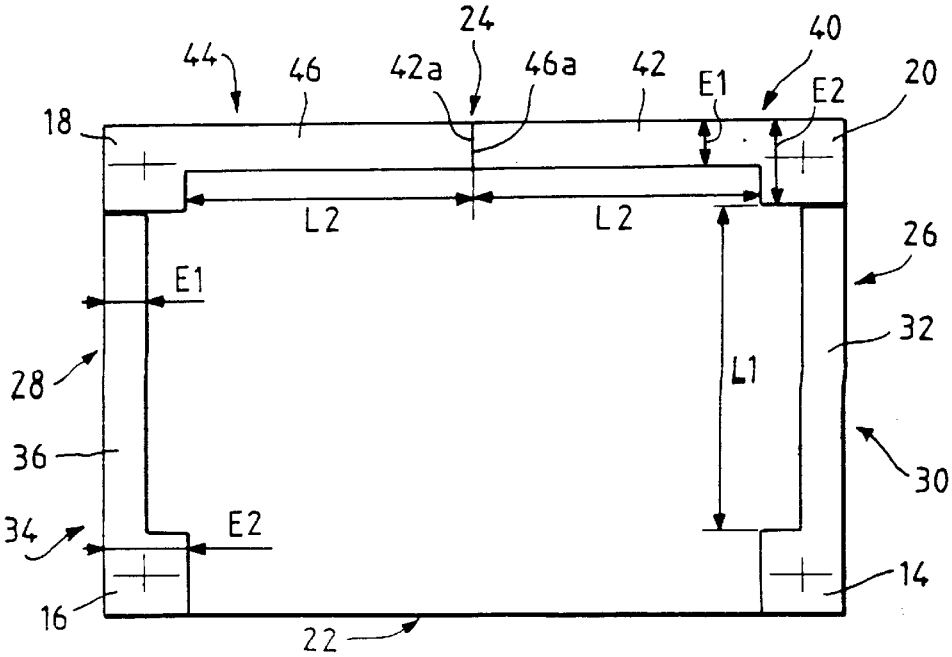

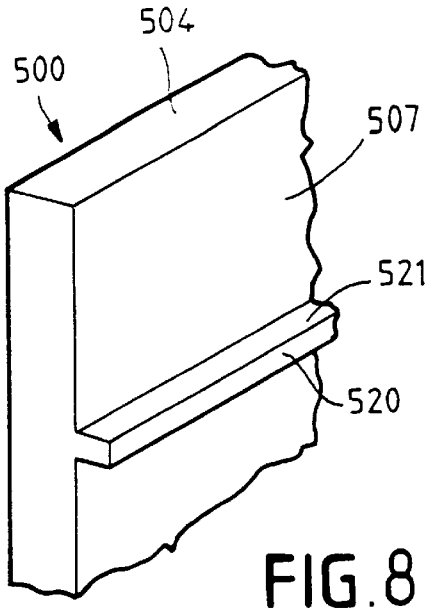
FIG.8
FIG.10
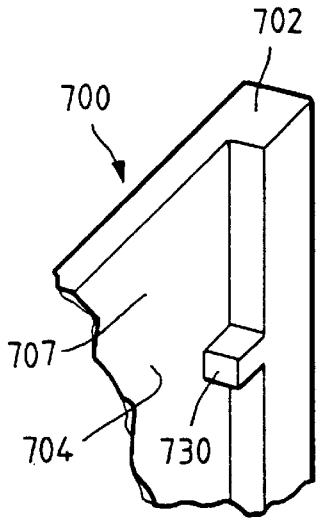
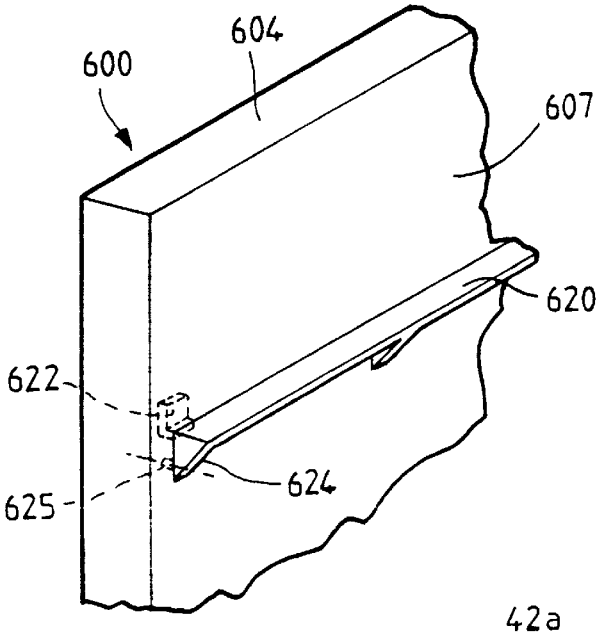
FIG.9
FIG.11
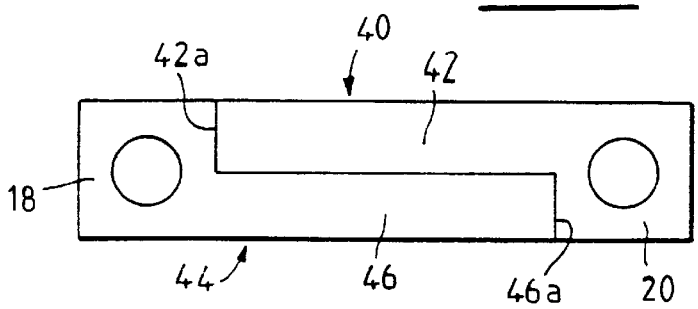

STORAGE FURNITURE

The present invention relates to a piece of storage furniture including two substantially rectangular shelves, respectively a top shelf and a bottom shelf, and upright-forming means suitable for co-operating with said shelves to hold them one above the other, the piece assembled in this way having four faces comprising a front face, a back face, and two side faces. The piece of furniture also includes wall means suitable for closing at least one of said faces referred to as the "closed" face, the upright-forming means including respective first and second support elements respectively disposed at each of the two ends of said closed face when the piece of furniture is assembled.

BACKGROUND OF THE INVENTION

Furniture of this type is known in which the upright-forming means comprise four supporting posts respectively connecting the four corners of the top shelf to the four corners of the bottom shelf. In furniture of this type, the wall means of the closed face are constituted by a sheet which is conventionally made out of hardboard type material. To receive the sheet, each of the two support posts that are disposed at respective ends of the closed face includes a vertical groove in which one end of the sheet can be received. The posts are generally square in overall section.

It is common to seek to provide the piece of furniture with more than one closed face. Under such circumstances, the posts have at least two vertical grooves formed in two perpendicular sides and co-operating respectively with the walls of two perpendicular closed faces.

To facilitate manufacture, such vertical grooves are generally formed in the middle region of the supporting posts which are themselves conventionally made out of plastics material by molding or blow molding. The walls that are to be received in the grooves of the supporting posts cannot extend flush with the outside faces of the posts, but are slightly offset inwards from said faces. Because of manufacturing constraints concerning posts, it is practically impossible to make the grooves in such a manner as to enable the walls to extend flush with the posts. The resulting offset is unattractive in appearance and spoils the overall impression of solidity of the assembled piece of furniture.

It should also be observed that this type of furniture is commonly sold in kit form, i.e. in component parts which must be assembled together by the purchaser. The piece of furniture must therefore be easily transportable in the unassembled state, which means that the number of parts must be as small as possible and the packaging of said parts prior to the piece of furniture being assembled must be capable of being as compact as possible. It is also necessary to observe that it is desirable for the parts to be relatively lightweight without that spoiling the overall solidity of the piece of furniture.

The piece of furniture must also be very easy to assemble, which is another reason for minimizing the number of component parts.

U.S. Pat. No. 3,493,281 discloses a piece of furniture whose sides are single pieces of plastics material, each comprising one flank and two posts. Assembly is simplified thereby, however the packaging of that piece of furniture prior to assembly cannot be very compact.

OBJECT AND SUMMARY OF THE INVENTION

The invention seeks to remedy the drawbacks of known pieces of furniture by improving appearance and the overall impression of solidity, and to facilitate as much as possible delivery in kit form and assembly.

This object is achieved by the fact that the piece of furniture includes at least two analogous combination parts each having both a first portion which constitutes one of the first and second support elements and a second portion which is integral with the first and which constitutes a substantially plane flank extending from one side of the support element constituted by the first portion, the flanks of said two combination parts together forming the wall means of the same closed face, being of height no greater than the height of the support elements and of length substantially equal to half the distance between the two support elements when they are disposed at the ends of the closed face, and the free ends of said flanks being adjacent when the piece of furniture is assembled.

Since the flank of each combination part is integral with the support element, it is equally possible to manufacture said part so that the outside face of its flank is offset or flush relative to the support element. This provides great freedom as to the appearance that can be given to the walls of the piece of furniture. In addition, the material constituting the flank is naturally the same as that constituting the first support element, such that an impression of compactness and overall solidity is achieved. It should also be observed that the number of parts is small since in the prior art furniture it was necessary to provide two supporting posts and a separate wall in order to close one face of a piece of furniture, while the invention makes it possible to use only two parts for performing the same function.

The wall of the closed face is made up of two combination parts disposed in such a manner that the free ends of their flanks are adjacent (in which case, the first portion of either one of the combination parts constitutes, for the other combination part, the second support element mentioned above).

It is possible to achieve packaging that is more compact than with the piece of furniture of U.S. Pat. No. 3,493,291 by placing the two combination parts one on the other.

It is also possible to use two identical combination parts for closing two opposite faces of the piece of furniture.

It should also be observed that the invention makes it possible to use a combination part so as to close one of the faces of the piece of furniture only partially, thereby giving great freedom as to the final appearance of the assembled piece of furniture.

In a particularly advantageous configuration, the piece of furniture includes two analogous combination parts each having a flank of a thickness that is equal to substantially half the thickness of the support element.

This configuration makes it possible to package the component parts together in extremely compact form since the two combination parts can be placed against one another to form a unit of thickness equal to the thickness of the support element.

BRIEF DESCRIPTION OF THE DRAWINGS

The invention will be well understood and its advantages will appear better on reading the following detailed description of embodiments given as non-limiting examples. The description refers to the accompanying drawings, in which:

FIG. 1 is an elevation view of a piece of furniture of the invention;

FIG. 2 is a section view on line II—II of FIG. 1;

FIG. 4 shows a detail IV of FIG. 1 in vertical section;

FIGS. 8, 9, and 10 are fragmentary perspective views showing various types of fittings possible on the inside face of a combination part; and FIG. 11 shows two combination parts in their packaged position.

MORE DETAILED DESCRIPTION

Figure 3:
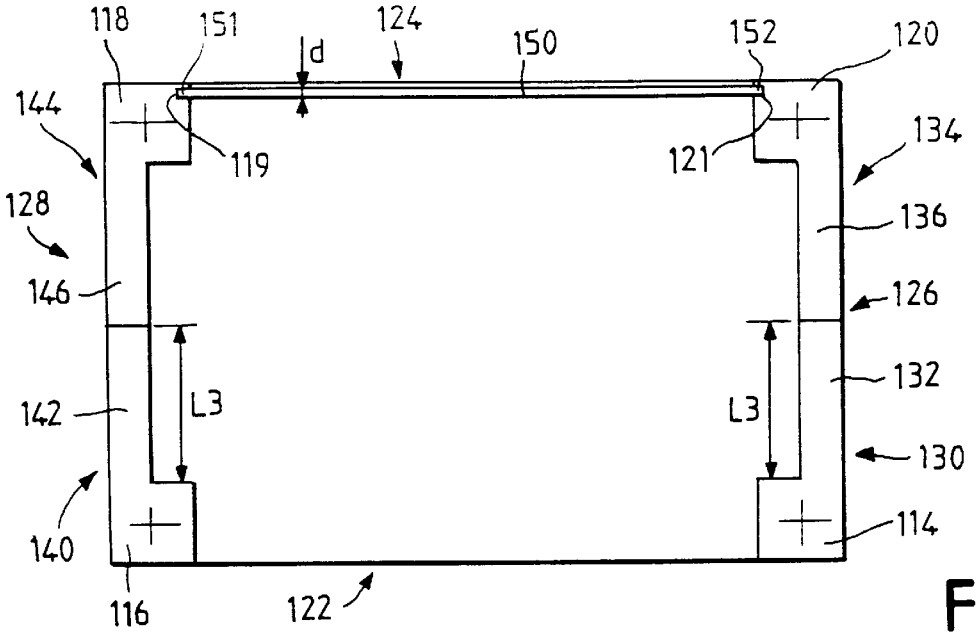
FIG. 3 is a view analogous to FIG. 2, showing a variant embodiment.

FIG. 1 shows a piece of furniture for storage comprising substantially rectangular top and bottom shelves 10 and 12. It is assumed below that these shelves are disposed horizontally.

The piece of furniture also includes upright-forming means which, once the piece has been assembled, co-operate with the top and bottom shelves to hold them one above the other. More precisely, as can be seen in the horizontal section of FIG. 2, the upright-forming means comprise four vertical elements 14, 16, 18, and 20 which, in the example shown, are disposed at the four corners of the shelves 10 and 12.

When the piece of furniture is assembled as shown in FIGS. 1 and 2, it comprises a front face 22, a back face 24, and two side faces 26 and 28.

It also includes wall-forming means closing at least one of its faces when assembled, with such a face being referred to as a "closed" face.

In the example shown, the front face 22 of the piece is open, whereas its back face 24 and its two side faces 26 and 28 are closed. It would also be possible to choose to close only one of the faces of the piece, e.g. only its back face.

For each closed face, the upright-forming means comprise first and second support elements, respectively disposed at each of the ends of the closed face under consideration once the piece of furniture has been assembled. Thus, the above-mentioned elements 18 and 20 respectively constitute the first and second support elements associated with the closed back face 24 and they are situated at the two side ends of said face. Likewise, the elements 14 and 20 on one side and the elements 16 and 18 on the other constitute respective first and second support elements for the closed faces 26 and 28 and are situated at the front and back ends of said faces.

Reference is made initially to the back face 24 of the piece of furniture which is closed by means of two analogous combination parts 40 and 44. Each of them comprises a first portion constituting a respective one of the support elements 20 and 18, and a second portion constituting a respective flank 42 or 46 which extends from one side of the support element forming the first portion of the combination part under consideration. When the piece of furniture is assembled, the flanks 42 and 46 extend parallel to the back edges of the shelves 10 and 12 defining the back face of the piece of furniture.

The height of the flanks 42 and 46 is substantially equal to the height H of the support elements, i.e. the height between the bottom face of the top shelf 10 and the top face of the bottom shelf 12.

Nevertheless, if it is desired to close the face 24 only partially in the vertical direction, the height of the flanks may be shorter than the height of the support elements.

The combination parts 40 and 44 are disposed in such a manner that the free ends 42*a* and 46*a* of their respective flanks 42 and 46 are adjacent to each other so that the back face 24 of the piece of furniture is completely closed by the support elements 18 and 20 and the two flanks 42 and 46.

The combination parts 40 and 44 are identical and the length L2 of their flanks 42 and 46 is equal to half the length between the two support elements 18 and 20.

For each combination part, the flank is integral with the support element. It can thus sometimes be difficult to distinguish the two portions of the combination part. In the example of FIG. 2, they can be distinguished because there is a difference in thickness between the flank and the support element. If that is not the case, it will be assumed that the condition whereby the length of the flank is no more than the distance between the two support elements means that the total length of the combination part is such that the free end of the combination part extends no further than the second support element when the piece of furniture is assembled.

In FIG. 2, the flanks 42 and 46 of the combination parts 40 and 44 constitute the wall means for a single closed face 24, whereas the flanks 32 and 36 of the combination parts 30 and 34 form respective entire wall means for the side faces 26 and 28 of the piece of furniture.

Thus, the closed face 26 comprises a combination part 30 whose first portion constitutes the first support element 14 of said face 26 and whose second portion integral with the first constitutes a substantially plane flank 32 extending from one of the sides of the first support element 14. The flank 32 of the combination part 30 is of a height substantially equal to the height H of the support elements, i.e. the height between the bottom face of the top shelf 10 of the piece of furniture and the top face of the bottom shelf 12.

Nevertheless, if it is desired to close the face 26 only partially in the vertical direction, the height of the flank may be smaller than that of the support elements.

When the piece of furniture is assembled, the flank 32 extends parallel to the edges of the top and bottom shelves which define the closed face 26. Its length L1 in this direction is substantially equal to the distance between the first and second support elements 14 and 20. The closed face 26 is thus completely closed by the outside faces of the support elements 14 and 20 and by the outside face of the flank 32. The combination part 30 is a one-piece part, with the flank 32 being integral with the first support element 14. It should be observed that it would also be possible to have a flank 32 of a length that is shorter than the distance between the elements 14 and 20 in order to close the face only partially.

A combination part 34 identical to the combination part 30 is associated with the closed face 28, the flank 36 of said combination part forming a wall for said closed face.

In the variant of FIG. 3, other wall means are associated with the combination parts. In this figure, the front face 122 of the piece of furniture is open, while its back face 124 and its side faces 126 and 128 are closed. The side faces 126 and 128 are closed in analogous manner to the back face 24 of the piece of furniture shown in FIG. 2, i.e. pairs of combination parts respectively 130 & 134 and 140 & 144 are associated in each of said faces. The flanks 132 and 136 of the combination parts 130 and 134 are of substantially equal length L3 in the depth direction, and together their total length is substantially equal to the distance between the support elements 114 and 120 disposed at the front and back ends respectively of the side face 126. Since the faces 126 and 128 are of the same length, the flanks 142 and 146 of the combination parts 140 and 144 are likewise of length L3.

The back face 124 of the piece of furniture is closed by means of a separate wall element 150. To hold this wall element, each of the two support elements 118 and 120 situated at respective opposite ends of the back face 124 has a respective vertical groove 119 or 121. The grooves face each other when the two combination parts 134 and 144 are in place, and the two ends 151 and 152 of the wall element 150 can be inserted into these grooves 119 and 121. It will be observed that an offset "d" remains between the back edges of the shelves 10 and 12 and the back face of the wall element 150. Nevertheless, insofar as this element is situated at the back of the piece of furniture, the offset does not spoil appearance irredeemably.

The invention thus makes it possible to associate conventional wall elements, e.g. of the hardboard type, for the wall element 150 with combination parts of the invention.

The combination parts 130, 134, 140, and 144 are practically identical, ignoring the grooves 119 and 121.

FIG. 4 is a vertical section view showing how the first portions of the combination parts are fixed to the top or bottom shelves. In the example shown, it can be seen how the top end of the first portion 16 of the combination part 34 is fixed to the top shelf 10. The shelf has a hole 50 in which a cylindrical extension 17 of the support element 16 is inserted, which extension projects beyond the top end 16*a* of the support element. The cylindrical extension 17 is threaded and its diameter is smaller than the diameter of the hole 50. The assembly is held in place by means of a cap 52 comprising a plate 54 from which there extends a hollow cylindrical sleeve 56. The outside diameter of the cylindrical sleeve 56 is substantially equal to the diameter of the hole 50, and the cylindrical inside face of the sleeve 56 is tapped so that the cap 52 and the extension 17 co-operate by screw engagement. The plate 54 may have an angular outside shape, e.g. it may be square, such that said plate provides grip that facilitates screw assembly without making it essential to use any special tool.

All of the support elements may be provided with such cylindrical extensions at each of their two ends. Nevertheless, if it is desired that two pieces of furniture of the same type should be easy to superpose, it is possible to provide for only one end of each support element to be provided with a threaded extension analogous to the extension 17, while the other end is provided with a hollow cylindrical sleeve analogous to the sleeve 56 of the cap 52. The user can thus choose not to superpose pieces of furniture by placing a cap fitted with a male cylindrical sleeve suitable for screw engagement in the hollow cylindrical sleeve, or to superpose two pieces of furniture, screwing the threaded male cylindrical extension of one support element into the tapped (female) hollow cylindrical sleeve of another support element.

The combination parts of the invention are compatible with that very simple method of fastening. Such combination parts can be made by molding or blow molding plastics material and they can be directly fitted with male or female fastening sleeves at the ends of their respective first portions.

To facilitate assembly of the piece of furniture, it is possible, after the cylindrical sleeves or extensions of the first portions of the combination parts have been engaged in the holes of the top and bottom shelves, to cause said combination parts to pivot by rotating them about an axis of rotation defined by said cylindrical sleeves or extensions in alignment, and finally to turn them so that their flanks come parallel to the edges of the shelves in order to perform final tightening.

In the example shown, as mentioned for the combination part 40 of FIG. 2, the thickness El of the flank of each combination part is substantially equal to half the thickness E2 of the first portion of the combination part, i.e. the support element. These thicknesses are naturally measured perpendicularly to the plane defined by the axis of the first support element and by the direction (perpendicular to said axis) in which the flank of the combination part extends from the first portion of said combination part.

As can be seen in FIG. 11, this disposition makes it possible to place two combination parts in such a manner as to enable the piece of furniture to be packaged in particularly compact manner for sale. This figure shows the combination parts 40 and 44 disposed for packaging. The inside faces of their flanks 42 and 46 are situated against each other and the free end 42*a* of the flank 42 is disposed against the inside face of the first portion 18 of the combination part 44 while the free end 46*a* of the flank 46 is placed against the inside face of the first portion 20 of the combination part 40. The two parts 40 and 44 disposed in this way form an assembly whose thickness is equal to the thickness E2 and whose width is equal to the width of a flank plus twice the width of a support element.

It should be observed, as shown in FIG. 2, that in addition to the two identical combination parts serving to close the same wall 24, it is possible to use two other identical combination parts 26 and 28 for closing each of the other two walls respectively. For packaging, these two parts can then be disposed in the manner shown in FIG. 11.

Figure 5:
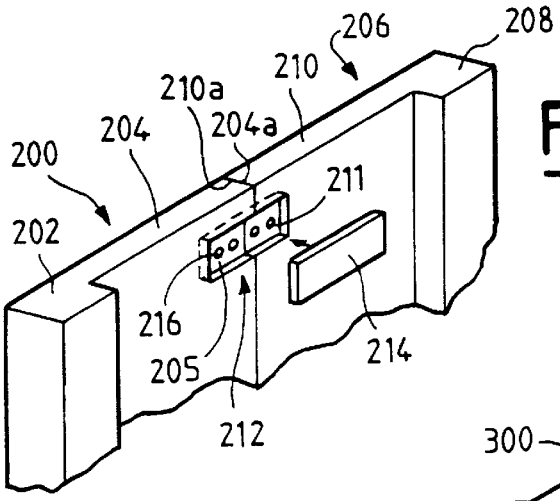
FIGS. 5, 6, and 7 are fragmentary perspective views showing several variants of the means for aligning adjacent flanks of two wall-closing combination parts.
Figure 6:
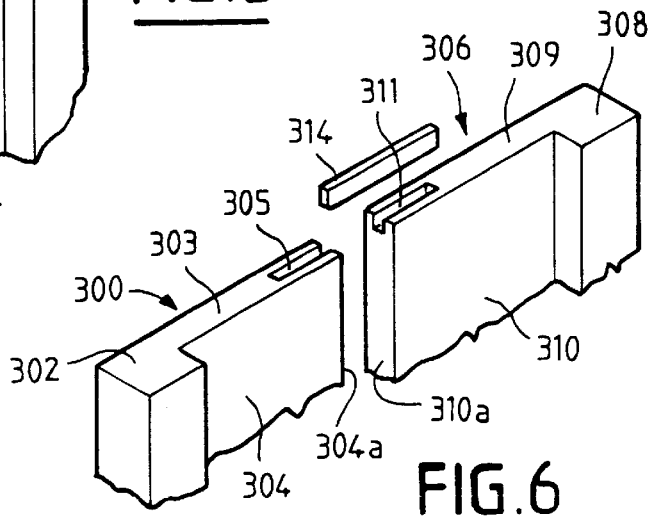
Figure 7:
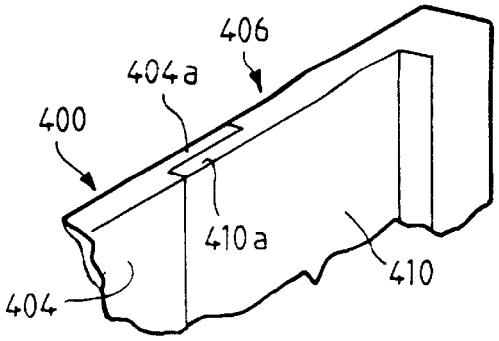

The piece of furniture advantageously includes means for aligning the flanks of the two combination parts forming the wall means of a closed face once the piece of furniture has been assembled. Three variants of such means are shown in FIGS. 5 to 7. It should be observed that the combination parts are represented highly diagrammatically, and in particular any sleeves with which they might be provided for fixing to the top and bottom shelves have been omitted.

In FIGS. 5 and 6, the means for aligning the flanks of two combination parts comprise an alignment member suitable for co-operating with the flanks of said combination parts in the vicinity of their adjacent free ends.

Thus, in FIG. 5, each of the combination parts 200 and 206 has a first portion constituted by a support element respectively referenced 202 and 208, and a second flank-constituting portion respectively referenced 204 and 206. These two combination parts are disposed in such a manner that the free ends 204*a* and 210*a* of the two flanks are adjacent and in alignment. Thus, each of the two flanks 204 and 210 has a respective notch 205 or 211 that is open to its free end. When the two combination parts 200 and 206 are disposed so that their free ends are adjacent, the two notches 205 and 211 are in alignment with each other and form a setback 212. The alignment part 214 is of dimensions matching the setback. To hold the flanks of the combination parts in alignment, it suffices to dispose the alignment parts 214 in the setback 212.

In the example of FIG. 5, the notches 205 and 211 are made on the inside faces of the two flanks. Thus, the setback extends only in the vertical inside face. To facilitate securing the alignment part 214 in the setback, fastening means such as projecting studs and complementary cavities may be provided, respectively in the bottom of the setback and on the face of the part 214 that is to co-operate with said bottom. In the example shown, it is the bottom of the setback 214 which has the cavities 216 while the alignment part 214 is provided with studs of complementary shape (not shown). Naturally it is possible to use a complementary disposition.

In FIG. 6, the elements analogous to those of FIG. 5 are given the same references plus 100. Each of the flanks 304 and 310 has a respective notch 305 and 311 that is open to the respective free end 304*a* or 310*a*. This time, the notches are formed from the respective top edges 303 and 309 of the flanks under consideration. To keep the flanks 304 and 310 in alignment when their free ends are adjacent, it suffices to insert an alignment strip 314 in the continuous setback formed by putting the notches 305 and 311 into alignment. Since this setback is open only to the top, it is possible to omit any fastening means for the strip in the notches.

It is also possible to select a variant that is different from FIGS. 5 and 6 by forming notches that are open both to the top edges and to the inside faces of the flanks. It should be observed that the alignment strip 314 of FIG. 6 can be directly secured to the bottom face of the top shelf 10 of the piece of furniture and be made integrally therewith. This part may be independent from or integral with one of the shelves of the piece of furniture.

In FIGS. 5 and 6, only the top ends of the combination parts are shown diagrammatically, however it must be understood that analogous alignment means may be provided in the vicinity of the bottom ends of said parts. It should also be observed that it would be possible to make the flanks without any notches and to provide a projecting abutment-forming strip on the bottom face of the top shelf and/or on the top face of the bottom shelf to position the flanks of the combination parts properly.

FIG. 7 shows another variant of the means for aligning the flanks of the two combination parts. Thus, the flank 404 of the combination part 400 and the flank 410 of the combination part 406 have respective lapped free ends extending up the full height of the flank and leaving respective tongues 404*a* and 410*a* of thickness substantially equal to half the thickness of the flanks. Thus, the tongue of one of the flanks constitutes a setback in which the tongue of the other flank is received to hold the flanks of the two combination parts in the aligned position when they form the wall of a face of the piece of furniture.

With reference to FIGS. 8 to 10, there follows a description of various ways of providing fittings on the inside faces of the combination parts enabling the piece of furniture to be provided with additional elements, such as one or more drawers, or one or more intermediate shelves.

FIGS. 8 and 9 are fragmentary perspective views showing a combination part constituting at least a portion of the wall means for one of the closed faces of the piece of furniture, with the opposite face of the piece of furniture likewise being closed by means of a flank of an analogous combination part. In these figures, the flanks of the two combination parts closing the two opposite walls of the piece of furniture are provided on their respective inside faces (i.e. their faces facing each other) with means forming horizontal slides. These fittings may be provided on each pair of two combination parts of the invention serving to close two opposite walls (FIG. 3) or on two additional combination parts serving to close two opposite walls (FIG. 2).

In FIG. 8, the inside face 507 of the flank 504 has a horizontal rib 520 whose top face 521 is plane. This horizontal rib is integral with the combination part, i.e. it is integrally formed therewith. Because of this conformation, when two analogous combination parts are used to constitute the two opposite walls of the piece of furniture, the horizontal ribs 520 are situated at the same height so that their respective top faces can serve as a sliding support for the edge of a drawer.

In FIG. 9, the inside face 607 of the flank 604 of the combination part 600 is provided with orifices to which a separate slide 620 can be fastened. This slide may be fitted with hooks 620 extending upwards and with bracket portions 624 having respective engagement pegs 625 on their faces for co-operating with the inside face 607. To enable said slide to be fastened, the flank 604 has orifices that open out to its inside face 607 and that are adapted respectively to receive the hooks 622 and the pegs 625.

In FIG. 10, the flank 704 of the combination part 700 includes at least one projection 730 integral with said combination part and situated on the inside face 707 thereof. The projection 730 may be one of the support elements for an intermediate shelf. For example, the combination parts 130, 134, 140, and 144 of FIG. 3 could each be equipped with a projection of this type. The four projections situated at the same height then constitute four support points for an intermediate shelf. Naturally a plurality of projections could be spaced apart vertically so as to enable a plurality of intermediate shelves to be installed. In analogous manner, it is possible to equip the inside faces of the flanks 30 and 34 with a plurality of projections of this type for supporting one or more intermediate shelves.

In the example shown in FIG. 10, the projection 730 is disposed in the junction zone between the flank 704 and the support element 702 of the combination part 700.

It should be observed that it would also be possible to provide the flank of one or a plurality of combination parts with cavities enabling separate support elements to be fastened for supporting one or more intermediate shelves.

I claim:

1. A piece of storage furniture comprising:

two substantially rectangular shelves, respectively a top shelf and a bottom shelf;

upright-forming means for holding said top shelf above said bottom shelf, the upright-forming means in conjunction with said shelves providing four faces comprising a front face, a back face, and two side faces, each one of said four faces having two ends;

wall means for closing at least one of said faces to form a closed face;

each upright-forming means comprising first and second support elements each of the first support and second support elements being associated one of the two ends of said closed face when the piece of furniture is assembled and being of sufficient size and strength to hold the top shelf above the bottom shelf;

at least one pair of combination parts, each part having both a first portion, which comprises one of the first and second support elements, and a second portion which is integral with the first portion and which comprises a substantially planar flank extending from one side of the first portion to a free end, the flanks of said pair of combination parts together forming the wall means of the closed face, and being of a height no greater than a height of the support elements and of a length substantially equal to half a distance between the support elements of the pair of combination parts when they are disposed at the ends of the closed face, and the free ends of said flanks being adjacent to each other when the piece of furniture is assembled;

means for fixing the first portions of the at least one pair of combination parts to at least one of said top and bottom shelves, said means comprising, for each combination part:

a cylindrical extension projecting from an end of the first portion of the combination part;

a corresponding hole in said at least on of said top and bottom shelves; and a hollow cylindrical sleeve, said extension and said sleeve being adapted to be engaged in said hole by a screw engagement.

2. A piece of furniture according to claim 1, including means for aligning the flanks of the at least one pair of combination parts when the piece of furniture is assembled.

3. A piece of furniture according to claim 2, wherein the means for aligning the flanks of the at least one pair of combination parts comprise an alignment member positioned proximate to the adjacent free ends.

4. A piece of furniture according to claim 1, including at least two combination parts wherein the flanks comprise at least a portion of the wall means of the at least two closed faces, the flanks having inside and outside faces and representing horizontal slide-forming means on the inside faces.

5. A piece of furniture according to claim 4, wherein the horizontal slide-forming means are constituted by a rib integral with each combination part.

6. A piece of furniture according to claim 1, further comprising an additional pair of combination parts having substantially the same conformation as the said at least one pair of combination parts, each combination part of the additional pair comprising a support element and a flank integral with the support element and extending from the support element to a free end, the free ends of the flanks being adjacent to each other to close two additional faces of the piece of furniture.

7. A piece of furniture according to claim 1, wherein the combination parts are molded plastic material.

8. A piece of furniture according to claim 1, wherein the combination parts are blow-molded plastic material.

9. A piece of furniture according to claim 1, wherein each flank has a lapped portion at the free end extending over the full height of the flank and leaving a tongue having a thickness substantially equal to half the thickness of the flank.

10. A piece of furniture according to claim 1, wherein each flank includes at least one projection integral with the flank, the projection being situated on an inside face of the flank, and being suitable for constituting a support element for an intermediate shelf.

11. A piece of storage furniture comprising:

two substantially rectangular shelves, respectively a top shelf and a bottom shelf;

upright-forming means for holding said top shelf above said bottom shelf, the upright-forming means in conjunction with said shelves providing four faces comprising a front face, a back face, and two side faces, each one of said four faces having two ends;

wall means for closing at least one of sad faces to form a closed face;

each upright-forming means comprising first and second support elements each of the first support and second support elements being associated with one of the two ends of said closed face when the piece of furniture is assembled and being of sufficient size and strength to hold the top shelf above the bottom shelf;

at least one pair of combinations parts, each part having both a first portion, which comprises one of the first and second support elements, and a second portion which is integral with the first portion and which comprises a substantially planar flank extending from one side of the first portion to a free end, the flanks of said pair of combination parts together forming the wall means of the closed face, and being of a height no greater than a height of the support elements and of a length substantially equal to half a distance between the support elements of the pair of combination parts when they are disposed at the ends of the closed face, and the free ends of said flanks being adjacent to each other when the piece of furniture is assembled;

wherein, for each at least one pair of combination parts, the flank of each combination part is of a thickness that is substantially equal to half a thickness of the support element of each combination part;

means for fixing the first portions of the at least one pair of combination parts to at least one of said top land bottom shelves, said means comprising, for each combination part:

a cylindrical extension projecting from an end of the first portion of the combination part;

a corresponding hole in said at least one of said top land bottom shelves; and a hollow cylindrical sleeve, said extension and said sleeve being adapted to be engaged in said hole by a screw engagement.

12. A piece of furniture according to claim 11, including means for aligning the flanks of at least one pair of combination parts when the piece of furniture is assembled.

13. A piece of furniture according to claim 12, wherein the means for aligning the flanks of the at least one pair of combination parts comprise an alignment member positioned proximate to the adjacent free ends.

14. A piece of furniture according to claim 11, including at least two combination parts wherein the flanks comprise at least a portion of the wall means of the at least two closed faces, the flanks having inside and outside faces and representing horizontal slide-forming means on the inside faces.

15. A piece of furniture according to claim 14, wherein the horizontal slide-forming means are constituted by a rib integral with each combination part.

16. A piece of furniture according to claim 11, further comprising an additional pair of combination parts having substantially the same conformation as the said at least one pair of combination parts, each combination part of the additional pair comprising a support element and a flank integral with the support element and extending from the support element to a free end, the free ends of the flanks being adjacent to each other to close two additional faces of the piece of furniture.

17. A piece of furniture according to claim 11, wherein the combination parts are molded plastic material.

18. A piece of furniture according to claim 11, wherein the combination parts are blow-molded plastic material.

19. A piece of furniture according to claim 11, wherein each flank has a lapped portion at the free end extending over the full height of the flank and leaving a tongue having a thickness substantially equal to half the thickness of the flank.

20. A piece of furniture according to claim 11, wherein each flank includes at least one projection integral with the flank, the projection being situated on an inside face of the flank, and being suitable for constituting a support element for an intermediate shelf.

* * * * *